United States Patent [19]

Betsinger et al.

[11] 4,295,612

[45] Oct. 20, 1981

[54] SHOWER APPARATUS

[76] Inventors: James D. Betsinger, 19585 Rolling Acres Dr., South Bend, Ind. 46614; James P. Bailey, 552 Apache Dr., Batavia, Ill. 60510

[21] Appl. No.: 85,722

[22] Filed: Oct. 17, 1979

[51] Int. Cl.[3] ..... B05B 7/32

[52] U.S. Cl. ..... 239/310; 222/132

[58] Field of Search ..... 239/305, 310, 318, 350, 239/413, 407, 574, 581, 587; 222/124, 133, 132, 144.5, 636; 137/565, 604

[56] References Cited

U.S. PATENT DOCUMENTS

| | | | |
|---|---|---|---|
| 3,091,402 | 5/1963 | Palmer | 239/305 X |
| 3,384,306 | 5/1968 | Hanley | 239/587 X |
| 3,486,695 | 12/1969 | Novak | 239/305 X |
| 3,713,585 | 1/1973 | Conklin | 239/305 X |
| 3,720,352 | 3/1973 | Kozdowski | 239/305 X |

*Primary Examiner*—Andres Kashnikow
*Assistant Examiner*—Gene A. Church
*Attorney, Agent, or Firm*—Barnes, Kisselle, Raisch & Choate

[57] ABSTRACT

A shower apparatus comprising a shower head which is to be adapted to be connected to a source of water, means in the head operable by the flow of water to produce a vacuum, a housing having a plurality of reservoirs for containing diverse liquids such as shampoo, body oil and the like, a line extending from the vacuum producing means to the housing, first valve means in the housing for selectively connecting one of the reservoirs, a second valve means in the housing operable to isolate a portion of the liquid from the selected reservoir and thereafter provide communication to the line so that the predetermined quantity of liquid may be drawn by suction to the shower head where it is mixed with the water flowing out of the shower head.

24 Claims, 12 Drawing Figures

SHOWER APPARATUS

This invention relates to shower apparatus and particularly to apparatus which is operable to dispense a predetermined quantity of a selected liquid into the shower head as desired.

BACKGROUND AND SUMMARY OF THE INVENTION

It has heretofore been suggested as desirable from the standpoint of convenience and economy that it would be desirable to dispense a predetermined quantity of a selected liquid such as shampoo, body oil and the like, into the shower head as the person is taking a shower.

Among the objectives of the present invention are to provide a shower apparatus wherein a predetermined quantity of a selected liquid is dispensed into the shower head; wherein the apparatus is readily manufactured and assembled, efficient in operation, and requires minimum maintenance; and which includes a separate manually operable device for dispensing a selected liquid in full strength directly into the hand of the person taking the shower.

Basically, the shower apparatus comprises a shower head which is to be adapted to be connected to a source of water, means in the head operable by the flow of water to produce a vacuum, a housing having a plurality of reservoirs for containing diverse liquids, a line extending from the vacuum producing means to the housing, first valve means in the housing for selectively connecting one of the reservoirs, second valve means in the housing operable to isolate a portion of the liquid from the selected reservoir and thereafter provide communication to the line so that the predetermined quantity may be drawn by suction to the shower head.

DESCRIPTION

Figure 1:
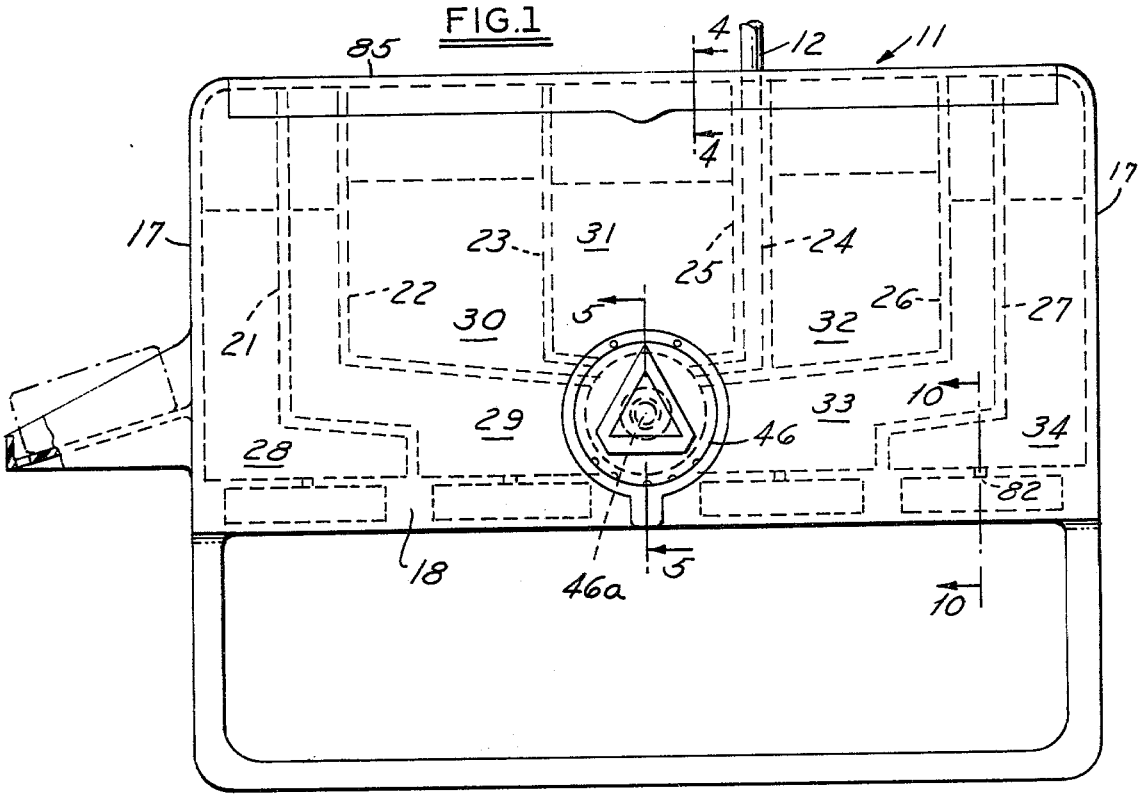
FIG. 1 is a front elevational view of a portion of the shower apparatus.
Figure 3:
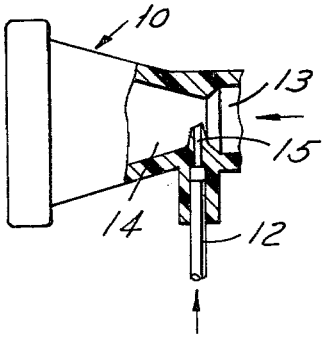
FIG. 3 is a part sectional elevational view of another portion of the apparatus.
Figure 2:
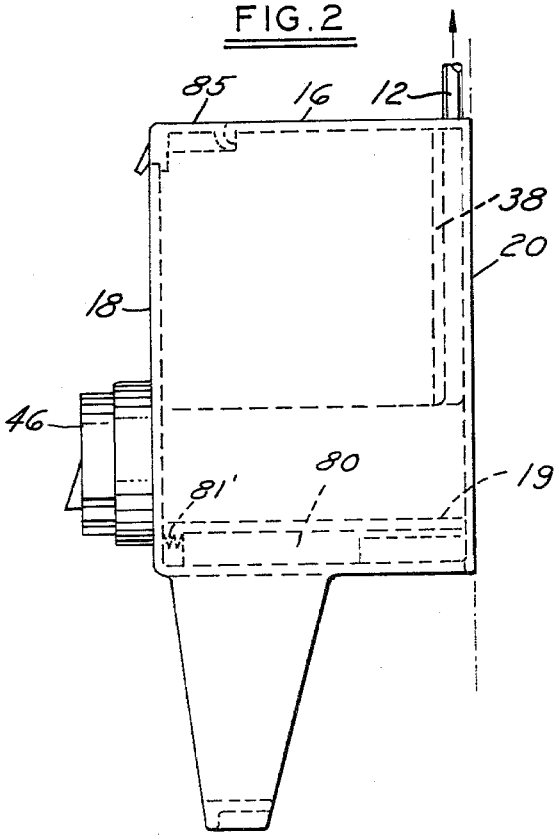
FIG. 2 is a side elevational view of the same.
Figure 5:
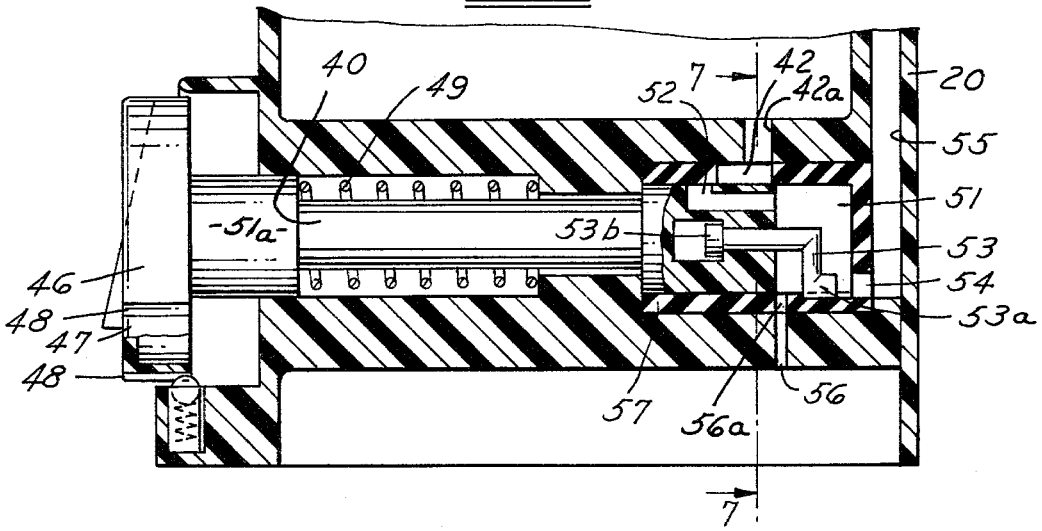
FIG. 5 is a fragmentary sectional view on an enlarged scale taken along line 5—5 in FIG. 1.

Referring to FIGS. 1-3, the shower apparatus embodying the invention comprises a shower head 10 which is adapted to be connected to a source of water in a conventional manner and a housing 11 that includes a line 12 connecting the housing to the shower head 10.

The shower head 10 is constructed and arranged to produce a suction so that when water flows through the shower head, a predetermined quantity of liquid stored in the housing 11 is drawn through the line 12 to the shower head and mixed with the water being dispensed. In the form shown in FIG. 3 the shower head has an opening 13 including a venturi 14 to which an orifice 15 is connected so that a suction is created as the water passes through the opening 13 and venturi portion 14 drawing liquid from the line 12.

The housing 11 is preferably made of a suitable plastic and is generally rectangular and includes a top wall 16, side wall 17, front wall 18, bottom wall 19 and rear wall 20. Housing 11 further includes intermediate walls 21,22,23,24,25,26 and 27 that divide the interior of the housing into a plurality of chambers or reservoirs 28–34 respectively. The reservoirs 28–34 are so shaped that a portion of the reservoir is formed by the bottom wall of the housing. In addition, the shape of each reservoir 30,31,32 inclusive is such that it communicates with an opening that in turn extends to a cylindrical opening 36 in a portion 37 that extends from the front wall 18 rearwardly to a secondary rear wall 38.

A first valve is provided in the opening 36 and functions to select a predetermined reservoir and upon actuation to permit a predetermined quantity of liquid from the selected reservoir to pass to a chamber where it is available for communication with the suction line 12. Specifically, a plastic plunger 40 is rotatably mounted in the opening 36. A sleeve 57 surrounds plunger 40 and includes openings 41–43 which are aligned with the openings **41*a*–43*a* from the reservoirs. The number of openings 41–43 corresponds with the number of reservoirs which are to be used herein shown as three, namely, reservoirs 30, 31, 32**.

Plunger 40 includes a knob 46, held in place by a screw **46*a*, for rotating the plunger and a detent comprising a rib 47 and groove 48 holds the knob 46 and in turn the plunger 40 in particular selected rotated position. A spring 49 normally urges the plunger outwardly of the housing. The spring is interposed between a portion of the body 50 and an enlarged portion 51*a* of the knob 46**.

Figure 6:
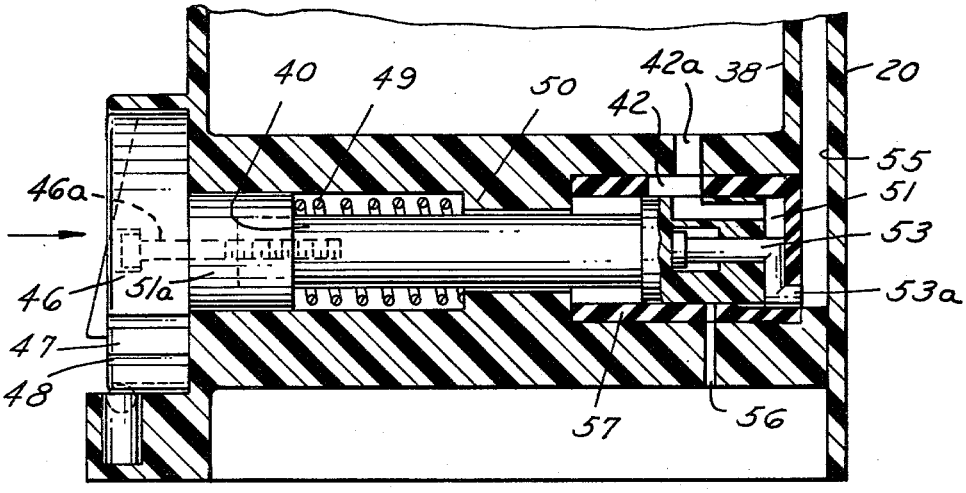
FIG. 6 is a fragmentary sectional view similar to FIG. 5 showing the parts in a different operative position.
Figure 7:
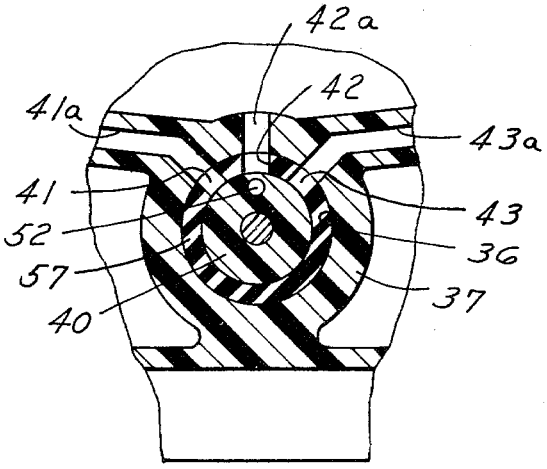
FIG. 7 is a fragmentary sectional view taken along the lines 7—7 in FIG. 5.

The portion 37 of the housing having the opening 36 therein also includes a chamber 51. When the plunger 40 is depressed against the action of the spring 49, communication is provided through a passage 52 in the plunger to the chamber 51 permitting a selected quantity of liquid to flow from the selected reservoir to chamber 51 (FIG. 6). During this time, a valve member 53 functions to close an opening 54 to a passage 55 formed by walls 38,20. Specifically, valve member 53 is generally L-shaped and includes a free end **53*a* associated with an opening 54 and a portion slidably mounted in plunger 40 and having an enlarged head 53*b*. Thus, valve 53 has a lost motion connection with plunger 40. When the plunger 40 is released, the plunger retracts the valve member 53 permitting the predetermined quantity of liquid in chamber 51 to be exposed through the opening 54 to the suction in the passage 55. A vent orifice 56 is provided in order to facilitate the action of suction. A seal is provided by a seal member 57** surrounding the end of the plunger in the area of the openings.

Figure 9:
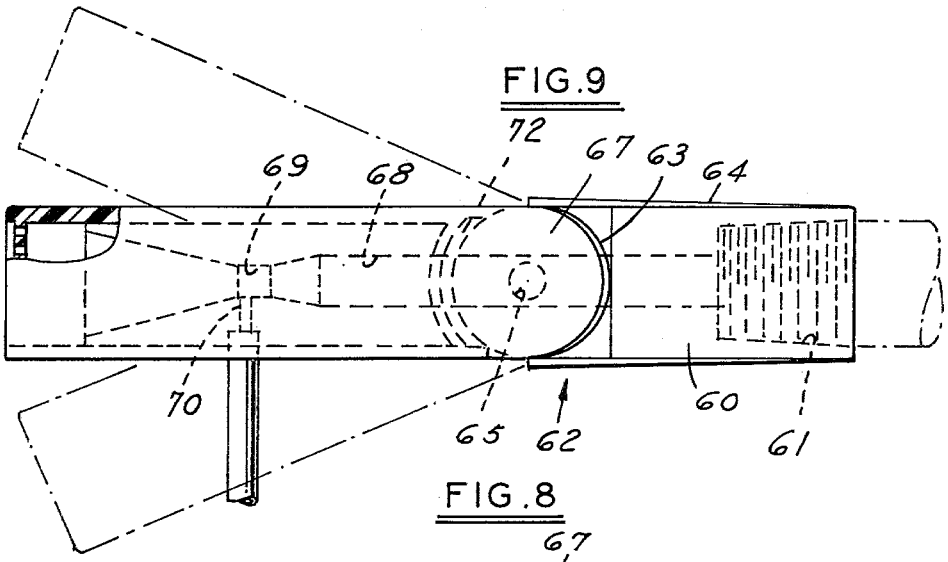
FIG. 9 is a side elevational view of the same.
Figure 8:
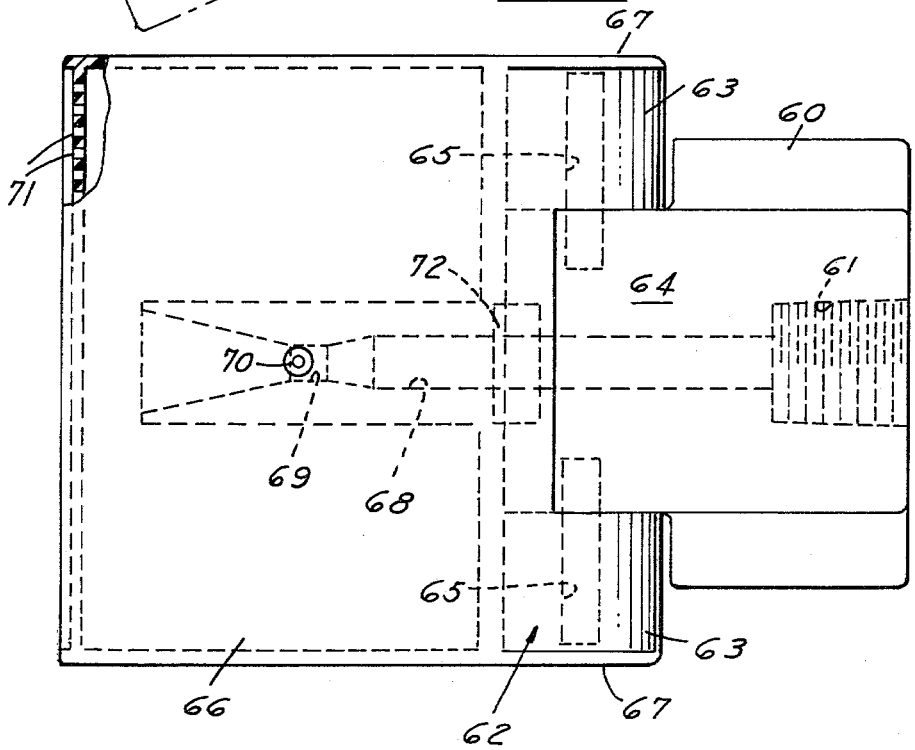
FIG. 8 is a plan view of a modified form of shower head.

In a preferred form of shower head, the shower head comprises a first part 60 (FIG. 8) made of plastic having an opening 61 therethrough which is adapted to be attached to the source of water and a second part 62 pivotally connected to the part 60 so that it is angularly movable as shown in FIG. 9. More specifically, the part 62 includes spaced portions 63 which are aligned with a central portion 64 of the part 60 and pivot pins 65 extend through openings in the portion 63 and 64. The shower head further includes a third part 66 that telescopes over the part 62 and has a portion 67 overlying the portions 63 and pins 65. The part 62 includes an opening 68 which is aligned with the opening 61 and has a venturi 69 and orifice 70 communicating with a restricted portion of the venturi to which the suction line from the housing is attached. The part 66 further includes a plurality of openings 71.

The parts 60,62,66 are preferably made of a suitable plastic and the portions 67 are connected to the portions 63 by use of adhesive or ultransonic bonding.

In use, the water flowing through the opening 61 and in turn the opening 68 and venturi 69 passes to a chamber defined by the part 66 surrounding the part 62 and then out through the openings 71. The suction formed at orifice 70 functions to draw the selected liquid from one of the reservoirs in the apparatus and it passes outwardly into the chamber mixing with the water and being dispensed through the openings 71.

The parts 61,62 have generally arcuate cooperating surfaces and a seal 72 is provided therebetween.

Figure 10:
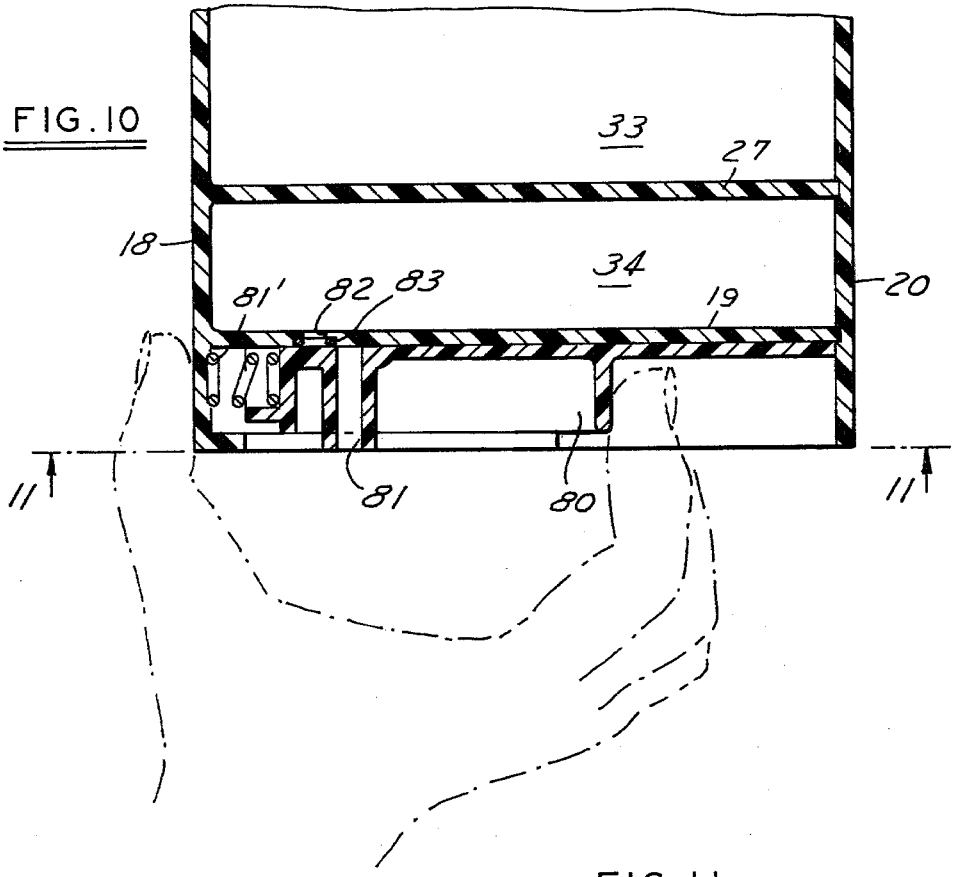
FIG. 10 is a fragmentary sectional view taken along the line 10—10 in FIG. 1.
Figure 11:
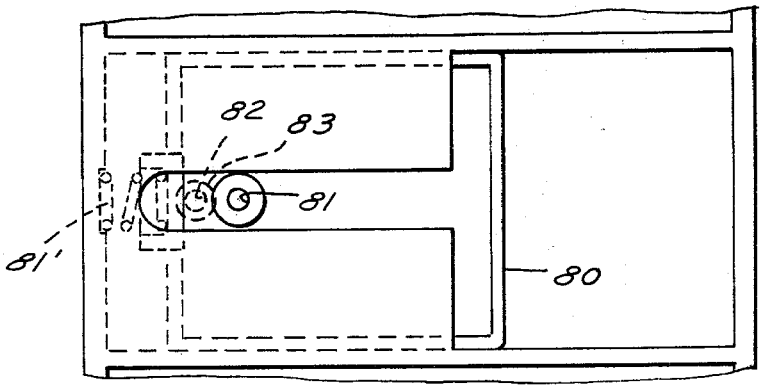
FIG. 11 is a view taken along the line 11—11 in FIG. 10.
Figure 12:
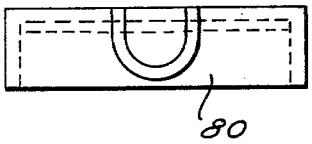
FIG. 12 is an end view of a part of the apparatus shown in FIGS. 10 and 11.

In the event the user wishes to dispense the liquid from the reservoirs 28,29,33,34 in full strength, each of these reservoirs is provided with a manually operable valve adjacent the bottom wall for dispensing the liquid manually. Each of these valves comprises a slidable valve member 80 along the bottom wall adjacent each reservoir having an opening 81 that is adapted to be aligned with a selected opening 82 in each bottom wall reservoir so that when grasped as indicated in FIG. 10 and moved against the action of the spring, the openings 81,82 are aligned. A resilient member 83 normally provides a seal between the slide member and the bottom wall and the opening 82 is preferably tear drop shaped in order to provide effective cutoff.

Each slide member 80 is maintained for movement in the reciprocating motion by side and bottom walls formed as an integral part of the housing.

The housing 11 is preferably formed in two parts. One part comprises the top wall, bottom wall, front wall and side walls with the intermediate walls 21–26 molded as a part thereof. The other part comprises the rear wall. In this manner, the valve including the plunger 40 and associated parts and the slide valve 80 can be assembled after which the rear wall is bonded by adhesive or ultrasonically.

Figure 4:
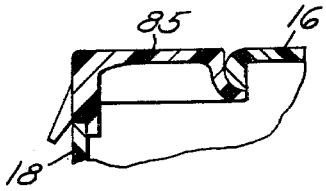
FIG. 4 is a fragmentary sectional view taken along line 4—4 in FIG. 1.

In order to provide access to the reservoir, the housing includes a removable panel 85 that is hinged by cooperating portions to the top wall 16 and can be pivoted upwardly (FIG. 4).

We claim:

1. A shower apparatus comprising a shower head which is to be adapted to be connected to a source of water, means in said head operable by the flow of water to produce a vacuum, a housing having a plurality of reservoirs for containing diverse liquids, a line extending from said vacuum producing means to said housing, first valve means in said housing for selectively connecting one of said reservoirs to said line, second valve means in said housing operable to isolate a portion of the liquid from the selected reservoir and thereafter provide communication to said line so that said predetermined quantity may be drawn by suction to said shower head.

2. The shower apparatus set forth in claim 1 wherein said second valve means is so constructed and arranged that when it is moved in one direction it permits a predetermined quantity of fluid to flow from said reservoir and when moved in the opposite direction, it provides communication to said line to said shower head.

3. The shower apparatus set forth in claim 2 including yielding means urging said second valve means into position providing communication to said line.

4. The shower apparatus set forth in claim 3 wherein said second valve means includes a chamber, a plunger, said plunger being operable upon being moved in one direction to provide communication between said chamber and a reservoir and thereby permit a predetermined quantity of liquid to flow into said chamber, said housing having an opening from said chamber and a passage communicating from said opening to said line, a valve member normally closing said last-mentioned opening, and lost motion means between said valve member and said plunger operable to retract said valve member when said plunger is moved in the other direction permitting communication between said chamber and said line through said opening and passage.

5. The shower apparatus set forth in claim 4 wherein said first valve means comprises a second valve member on said plunger, said plunger being rotatable such that said second valve member is rotated to provide communication to a selected reservoir.

6. The shower apparatus set forth in claim 4 including an air vent to said chamber.

7. The shower apparatus set forth in claim 1 including a separate manually operable valve for each said chamber for dispensing liquid from said reservoir.

8. The shower apparatus set forth in claim 7 wherein said last-mentioned means comprises an opening from said reservoir, a slide valve member normally closing said opening, and means on said slide member adapted to be gripped for moving said slide member by squeezing action of the hand to provide communication through said opening to the exterior of the housing.

9. The shower apparatus set forth in claim 8 wherein said last-mentioned opening is teardrop-shaped in cross section.

10. The shower apparatus set forth in claim 9 wherein said pump means comprises a restricted passage through which the water passes to said shower head and an orifice extending to the restricted portion such that the suction is formed at said orifice, said line being connected to said orifice.

11. The shower apparatus set forth in claim 10 wherein said shower head comprises a first part adapted to be connected to a source of water, a second part, means for mounting said second part on said first part for pivotal movement about a transverse axis, said second part having an opening adapted to be aligned with the opening in said first part, said opening in said second part haing a venturi-shape portion, a third part surrounding said first part and defining a pressure chamber into which water is directed from said venturi, said third part having a plurality of openings therein, a passage extending from the restricted portion of said venturi, said line being connected to said passage.

12. The shower apparatus set forth in claim 11 wherein said means for pivotally connecting said first part to said second part comprises cooperating arcuate surfaces on said first and second part, seal means between said first and second part at said surfaces surrounding the openings therein, said second part having portions thereof aligned with a portion of said first part, pivot pins extending through said aligned portions, said third part having portions thereof extending and overlying the pivot pins.

13. A shower apparatus comprising a shower head which is to be adapted to be connected to a source of water, means in said head operable by the flow of water to produce a vacuum, a housing having a back wall and part having top, side, bottom walls and intermediate walls cooperating to define a plurality of reservoirs for containing diverse liquids, a line extending from said vacuum producing means to said housing, first valve means in said housing for selectively connecting one of said reservoirs to said line, second valve means in said housing operable to isolate a portion of the liquid from the selected reservoir and thereafter provide communication to said line so that said predetermined quantity may be drawn by suction to said shower head.

14. The shower apparatus set forth in claim 13 wherein said second valve means is so constructed and arranged that when it is moved in one direction it permits a predetermined quantity of fluid to flow from said reservoir and when moved in the opposite direction, it provides communication to said line to said shower head.

15. The shower apparatus set forth in claim 14 including yielding means urging said second valve means into position providing communication to said line.

16. The shower apparatus set forth in claim 15 wherein said second valve means includes a portion extending from said front wall chamber, a plunger in said wall portion, said plunger being operable upon being moved in one direction to provide communication to said chamber and thereby permit a predetermined quantity of liquid to flow into said chamber, said portion of said housing having an opening from said chamber and a passage communicating from said opening to said line, a valve member normally closing said last-mentioned opening, and lost motion means between said valve member and said plunger operable to retract said valve member when said plunger is moved in the other direction permitting communication between said chamber and said line through said opening and passage.

17. The shower apparatus set forth in claim 16 wherein said first valve means comprises a second valve member on said plunger, said plunger being rotatable such that said second valve member is rotated to provide communication to a selected reservoir.

18. The shower apparatus set forth in claim 16 including an air vent to said chamber.

19. The shower apparatus set forth in claim 13 including a separate manually operable valve for each set chamber for dispensing liquid from said reservoir.

20. The shower apparatus set forth in claim 19 wherein said last-mentioned means comprises an opening from said reservoir, a slide valve member normally closing said opening, and means on said slide member adapted to be gripped for moving said slide member by squeezing action of the hand to provide communication through said opening to the exterior of the housing.

21. The shower apparatus set forth in claim 20 wherein said last-mentioned opening is tear-shaped in cross section.

22. The shower apparatus set forth in claim 21 wherein said pump means comprises a restricted passage through which the water passes to said shower head and an orifice extending to the restricted portion such that the suction is formed at said orifice, said line being connected to said orifice.

23. The shower apparatus set forth in claim 10 wherein said shower head comprises a first part adapted to be connected to a source of water, a second part, means for mounting said second part on said first part for pivotal movement about a transverse axis, said second part having an opening adapted to be aligned with the opening in said first part, said opening in said second part having a venturi-shape portion, a third part surrounding said second part and defining a pressure chamber into which water is directed from said venturi, said third part having a plurality of openings therein, a passage extending from the restricted portion of said venturi, said line being connected to said passage.

24. The shower apparatus set forth in claim 23 wherein said means for pivotally connecting said first part to said second part comprises cooperating arcuate surfaces on said first and second part, seal means between said first and second part at said surfaces surrounding the openings therein, said second part having portions thereof aligned with a portion of said first part, pivot pins extending through said aligned portions, said third part having portions thereof extending and overlying the pivot pins.

* * * * *